US010569160B1

(12) United States Patent
Peel

(10) Patent No.: US 10,569,160 B1
(45) Date of Patent: Feb. 25, 2020

(54) DEVICE FOR PATTERN-BUILDING WITH PROJECTILES

(71) Applicant: John Peel, Waco, TX (US)

(72) Inventor: John Peel, Waco, TX (US)

(73) Assignee: Peel Enterprises Inc., Waco, TX (US)

( * ) Notice: Subject to any disclaimer, the term of this patent is extended or adjusted under 35 U.S.C. 154(b) by 0 days.

(21) Appl. No.: 16/120,559

(22) Filed: Sep. 4, 2018

(51) Int. Cl.

| | |
|---|---|
| ***A63B 63/00*** | (2006.01) |
| ***A63F 9/00*** | (2006.01) |
| ***A63F 3/00*** | (2006.01) |
| ***A63F 7/30*** | (2006.01) |
| ***A63F 7/40*** | (2006.01) |
| ***A63F 11/00*** | (2006.01) |
| ***A63F 9/02*** | (2006.01) |
| *A63F 7/00* | (2006.01) |
| *A63B 63/08* | (2006.01) |
| *A63B 67/06* | (2006.01) |

(52) U.S. Cl.
CPC ..... *A63F 9/0073* (2013.01); *A63F 3/00094* (2013.01); *A63F 7/305* (2013.01); *A63F 7/40* (2013.01); *A63F 9/0278* (2013.01); *A63F 11/0051* (2013.01); *A63B 63/00* (2013.01); *A63B 63/08* (2013.01); *A63B 63/083* (2013.01); *A63B 67/06* (2013.01); *A63F 2003/00406* (2013.01); *A63F 2003/00798* (2013.01); *A63F 2007/0064* (2013.01); *A63F 2007/4006* (2013.01)

(58) Field of Classification Search
CPC ..... A63B 63/00; A63B 67/06; A63B 63/08; A63B 63/083
USPC ..... 273/398–402, 138.4
See application file for complete search history.

(56) References Cited

U.S. PATENT DOCUMENTS 858,990 A * 7/1907 Kemper ..... A63F 7/02 273/394
970,881 A * 9/1910 Cadwallader ..... A63B 63/00 273/317.6
1,037,877 A * 9/1912 Doerr ..... A63F 9/02 273/138.4
1,371,867 A * 3/1921 Dean ..... A63B 47/025 273/397

(Continued)

OTHER PUBLICATIONS

Epic Giant Basketball Connect 4 Game! Jul. 28, 2017 https://www.bing.com/videos/search?g=epic+giant+basketball+connect+4&&view=detail&mid=294AD1BC2AD6031708F0294AD1BC2AD6031708F0&&FORM=VRDGAR (Year: 2017).*

(Continued)

*Primary Examiner* — Mark S Graham
(74) *Attorney, Agent, or Firm* — McDonnell Boehnen Hulbert & Berghoff LLP

(57) ABSTRACT

A device is provided for receiving projectiles and creating a pattern. The device includes a plurality of hoops arranged in parallel and configured to receive the projectiles. A two-dimensional grid could be provided—across a plurality of channels of the device, or on a display of the device—in order to display the projectiles received by the plurality of hoops. In some examples, projectiles may be received by a plurality of channels, and the pattern is created within the channels and is viewable through apertures across the channels. In other examples, sensors may be used to determine when a projectile has passed through one of the hoops, and indicators may be displayed in corresponding vertical columns of a two-dimensional grid on a display.

19 Claims, 5 Drawing Sheets

(56) References Cited

U.S. PATENT DOCUMENTS 1,442,054 A * 1/1923 Dixon ..... A63F 9/0204 273/397
1,531,455 A * 3/1925 Russell ..... A63F 7/02 273/120 R
2,959,415 A * 11/1960 Peterson ..... A63F 9/02 273/138.3
3,656,750 A * 4/1972 Meunier ..... A63F 9/0204 273/396
3,797,828 A * 3/1974 Ishikawa ..... A63F 7/025 273/121 B
4,245,842 A * 1/1981 Kuna ..... A63F 7/02 124/17
4,796,886 A * 1/1989 Loh ..... A63B 63/00 273/401
7,900,925 B2 * 3/2011 Hextall ..... A63F 3/00 235/64
8,794,629 B1 * 8/2014 Humphreys, Jr. ..... A63B 67/06 273/400
2010/0090407 A1 * 4/2010 Lin ..... A63B 24/0021 273/371

OTHER PUBLICATIONS

"Epic Giant Basketball Connect 4 Game!" by Flow Ridiculous, https://www.youtube.com/watch?v=UuO2gxS2IQ4, Jan. 28, 2017.
"Connect 4 Basketball Edition!!! #BossTalks Ep.6 [Season 2]" by AntoDaBoss, https://www.youtube.com/watch?v=QtZygXsWq4k, Sep. 13, 2017.
"Connect 4 basketball." by sroberts6221, https://www.youtube.com/watch?v=3jwUYvFfl-o, Dec. 15, 2017.
"Connect Basketball—So Awesome!" by J. Charles Lavallee, https://www.youtube.com/watch?v=TWgCucrOiXk, Aug. 27, 2017.
"Shoot Four Promo Video—Connect 4 basketball" by NPA Events, https://www.youtube.com/watch?v=PYyt5N_JVSw, Feb. 28, 2018.

* cited by examiner

DEVICE FOR PATTERN-BUILDING WITH PROJECTILES

BACKGROUND

Multiplayer games of skill have been popular for centuries, and many have risen to great commercial success. While many games are designed for tabletop play, using tokens, chips, or other small-scale game pieces, in some cases it may be desirable to provide games that can be played with sports balls, projectiles, or other large game pieces. Such large scale skill games may facilitate gameplay, encourage onlooker viewership and participation, provide additional game elements, add complexity to the game mechanics, and/or provide additional space for advertisements and other design elements. In particular, larger scale games may be favorable for sporting events, concerts, and other events, where attractions are desirably easy-to-locate and include additional space for players and spectators.

SUMMARY

Many games of skill are played with more than one person, and the game mechanics and/or strategy may depend on the interplay between opposing players. In some games, players may aim to build a desired pattern within a two-dimensional grid using chips, balls, or other game pieces. Players may alternate turns by inserting game pieces into channels within the grid in order to create a desired pattern and/or prevent an opposing player from creating the pattern. When a desired pattern is achieved, one player is declared the winner, and the game pieces are removed from the two-dimensional grid.

In some cases, such a pattern-building game could be played with projectiles, for instance, basketballs or other sports balls. Such a game could provide players the strategy and complexity of a skill game, while at the same time testing their hand-eye coordination, accuracy, and other motor skills.

In a first implementation, a device is provided. The device includes a plurality of substantially vertical longitudinal channels arranged in parallel and configured to receive projectiles. Each of the plurality of channels has a front end, a back end, two side ends, a top end, and a bottom end. The plurality of channels has openings at their respective top and bottom ends. The device further includes one or more plates positioned over the front ends of the plurality of longitudinal channels. The one or more plates contain a plurality of apertures located such that the apertures form a two-dimensional grid across the channels. The device includes a plurality of hoops disposed vertically above each of the top ends of the channels. Each hoop corresponds to a different channel. The device also includes a funnel positioned between the plurality of hoops and the plurality of channels. The funnel is arranged to guide any projectiles passing through any one of the hoops directly into the corresponding channel.

In a second implementation, a device is provided. The device includes a plurality of hoops arranged in parallel and configured to receive projectiles. The device also includes a plurality of sensors. Each sensor is disposed on a corresponding hoop and is configured to detect a projectile received by the corresponding hoop. The device further includes a collecting mechanism positioned behind the plurality of hoops. The collecting mechanism is arranged to collect any projectiles passing through any one of the hoops. The device yet further includes a display. The display includes a two-dimensional grid including a plurality of horizontal rows and a plurality of vertical columns. Each of the plurality of vertical columns corresponds to one of the plurality of hoops. The display is configured to indicate when a projectiles passes through the hoop by displaying an indicator in the corresponding vertical column.

Other implementations will become apparent to those of ordinary skill in the art by reading the following detailed description, with reference where appropriate to the accompanying drawings.

DETAILED DESCRIPTION

Figure 1A:
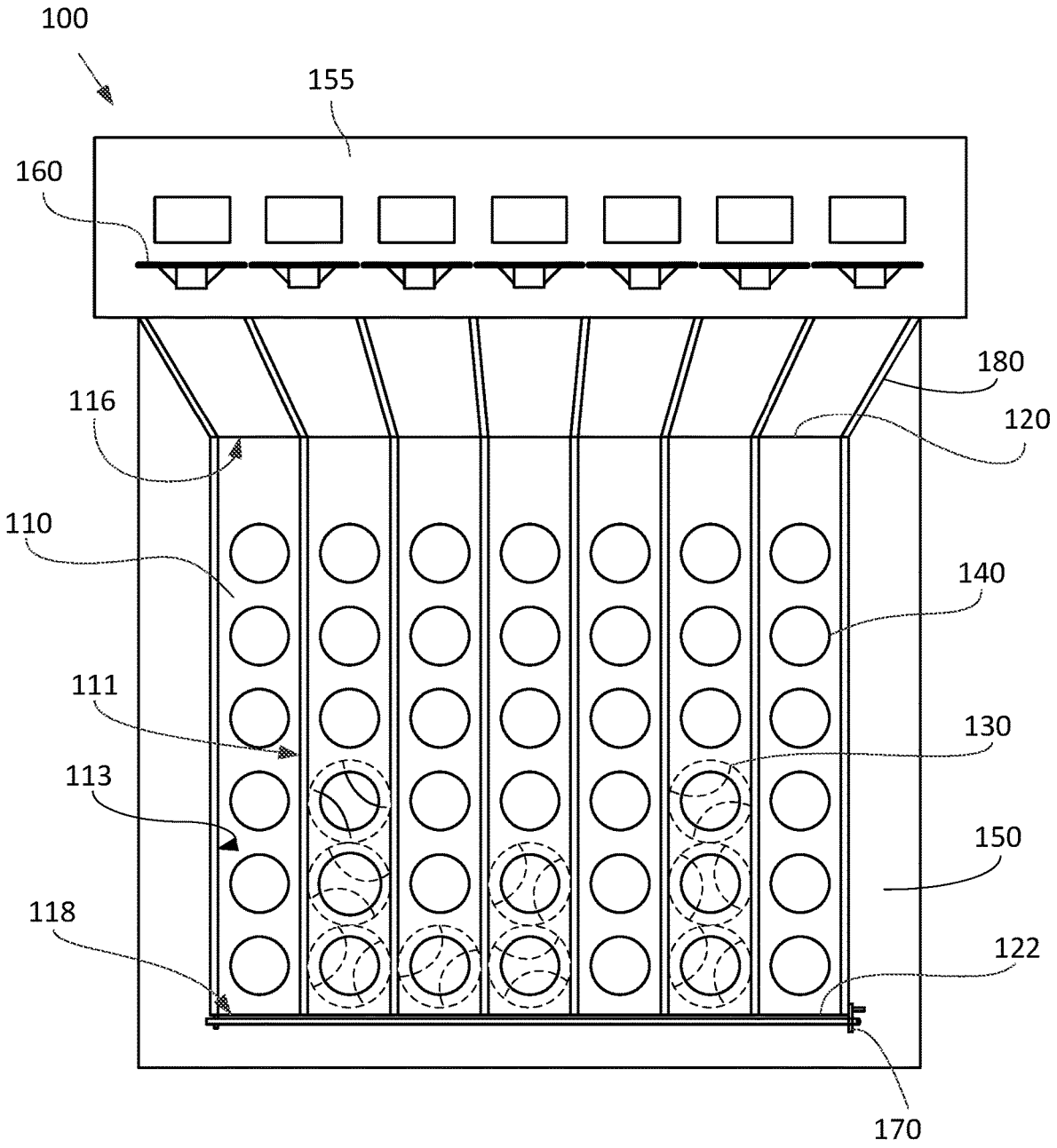
FIG. 1A illustrates a front side view of a device according to an example embodiment.

Example methods, devices, and systems are presently disclosed. It should be understood that the word "example" is used in the present disclosure to mean "serving as an instance or illustration." Any implementation or feature presently disclosed as being an "example" is not necessarily to be construed as preferred or advantageous over other implementations or features. Other implementations can be utilized, and other changes can be made, without departing from the scope of the subject matter presented in the present disclosure.

Thus, the example implementations presently disclosed are not meant to be limiting. Components presently disclosed and illustrated in the figures can be arranged, substituted, combined, separated, and designed in a wide variety of different configurations, all of which are contemplated in the present disclosure.

Further, unless context suggests otherwise, the features illustrated in each of the figures can be used in combination with one another. Thus, the figures should be generally viewed as components of one or more overall implementations, with the understanding that not all illustrated features are necessary for each implementation.

In an effort to provide technical context for the present disclosure, the information in this section can broadly describe various components of the implementations presently disclosed. However, such information is provided solely for the benefit of the reader and, as such, does not expressly limit the claimed subject matter. Further, components shown in the figures are shown for illustrative purposes only. As such, the illustrations are not to be construed as limiting. As is understood, components can be added, removed, or rearranged without departing from the scope of this disclosure.

I. Overview

For particular applications, events, and settings, it may be desirable to provide an interactive game that is played by throwing, tossing, lobbing, or otherwise introducing projectiles into a game grid to form a pattern. For instance, at sporting events, concerts, and other events, it may be desirable to provide attendees with a large-scale game that that is playable by one or more persons, visible from a distance, encourages spectator viewership, and/or provides ample advertisement, licensing, and sponsorship opportunities. Similarly, it could be desired to provide a game that can be played with projectiles, e.g., basketballs, footballs, golf balls, soccer balls, or some other projectiles, in order to add additional complexity to the game mechanics, facilitate gameplay, promote a sports team and/or sponsor, or for some other benefit.

Systems and devices herein generally relate to a device for pattern building with projectiles as a way of playing a pattern-based game. More specifically, the pattern building of the game takes place in a plurality of substantially vertical longitudinal channels configured to receive projectiles (e.g., game balls) through openings in the channels. When the projectiles are inside the channels, a releasable blocking mechanism is configured to selectively retain the projectiles within the channels, thereby allowing players to create a pattern using stacked and/or adjacent projectiles introduced into the plurality of channels. A plurality of apertures may be provided in a two-dimensional grid across the channels, thereby allowing players to view the projectiles within the channels while defining positions in a game grid for the pattern-building of the game.

The longitudinal channels are arranged in parallel in a substantially vertical manner, with openings at their respective top and bottom ends. The channels are sized to loosely receive projectiles, so that the projectiles can freely move through the channels (e.g., from the top end of a channel to the bottom end) when they are received in an opening of the channels. Depending on the size of the projectiles and/or the desired gameplay mechanics, the channels may have a width or diameter of about 9", about 10", about 12", or any other desired size. In some cases, the plurality of channels is mounted on a backing surface using an attachment mechanism. However, in other examples the channels may be rigid and freestanding and/or maintained in a vertical position using a stand.

One or more plates may be positioned over the front (i.e., player-facing) ends of the plurality of longitudinal channels. The plates contain a plurality of apertures located such that they form a two-dimensional grid across the channels. Vertical columns of the grid are defined by the plurality of channels, such that apertures of each column are arranged vertically across a channel. Meanwhile, the horizontal rows are arranged across the plurality of columns, with each aperture of a row corresponding to a different one of the plurality of columns.

In some examples, the one or more plates define/form a front end or face of the columns. However in other cases the plates may be attached atop channels. Similarly, in some instances the plates could be a single plate that stretches across all columns and includes apertures to form the entire two-dimensional grid. Alternatively, there could be a plurality of plates (e.g., with each plate corresponding to a single channel, vertical column, or horizontal row of the grid) positioned over the plurality of channels.

The device may also include a plurality of hoops disposed vertically above the top ends of the channels, such that a projectile received by one of the hoops falls into an opening a one of the channels. During gameplay, projectiles may be aimed one or more of the plurality of hoops in order to guide the projectile into a particular channel and, e.g., build a desired pattern. In some cases, each hoop of the plurality of hoops corresponds to a single channel. However, in other situations there may be a greater or lesser number of hoops compared to the number of channels. The hoops could be standard basketball rims; however, any size and configuration of hoops may fall within the present disclosure. For example, in some examples the hoops are arranged at approximately a 90 degree angle relative to the longitudinal channels (i.e., so that the opening of the hoops faces a player of the game). Other configurations are also contemplated.

The device may also include a funnel positioned between the plurality of hoops and the plurality of channels. The funnel may be positioned on the top end of the plurality of channels and configured to guide projectiles from the plurality of hoops into the top end openings of the channels. In this manner, the funnel may be arranged to guide projectiles passing through any one of the hoops directly into the channel associated with that hoop. In some cases, the funnel includes partitions that define separate pathways corresponding to certain hoop/channel pairs. The width and/or configuration of the channel may vary as appropriate for the game and spatial constraints. However, in some cases the width of a bottom end of the funnel is approximately sized to the width of the plurality of channels, and the width of a top end of the funnel is greater than or equal to the width of the plurality of hoops.

In some examples, the device also includes a releasable blocking mechanism to selectively retain the projectiles within the channels, and release the projectiles when desired by a player. In some examples, the releasable blocking mechanism is positioned at the bottom ends of the longitudinal channels. The releasable blocking mechanism includes a retaining mechanism and a latching mechanism. The releasable blocking mechanism could be configured to prevent received projectiles from exiting the channels by impeding the bottom end openings of the channels with the retaining mechanism, e.g., a horizontal bar, door, or other physical barrier. The latching mechanism could be configured to move the retaining mechanism between a first position (i.e., a retaining position, as described above) and a second position (i.e., a release position). In the second position, the retaining mechanism may be positioned away from the bottom end openings of the channels, thereby allowing the projectiles to exit the channels. In some examples, the latching mechanism can further include a pin configured to maintain the retaining mechanism in the first position, such that balls are retained within the channels during normal gameplay.

Such a device may come in a variety of form factors and configurations. For example, for sporting events it may be beneficial to provide a larger scale device attached to a truck, which can be leased and driven to an outdoor event. Such a device would also provide adequate space for advertisement, logos, sponsorships, and other event-specific displays. On the other hand, when space is at a premium (e.g., for consumer or at-home play), a smaller device may be provided that can be folded, disassembled, deflated, or otherwise shrunk for packaging, transit, and storage. Similarly, a device could be provided that attaches to a wall, the back of a door, or some other surface so that it can be played at home or in smaller areas. In such examples, a slim form factor may be desired, with a depth (i.e., a distance between a backboard or backing surface of the device and the front end of the channels) in the range of about 6 inches to about 18 inches.

Additional features are also envisioned. For instance, the device could include a collecting mechanism disposed below the bottom end openings of the plurality of channels.

Such a collecting mechanism (e.g., a net, a container, etc.) could be configured to gather the projectiles when they exit the channels, making it easier for players to collect the projectiles when the game has been completed.

In some examples, the device could also include electronic elements like a display, sensors, and the like. In such embodiments, sensors could be coupled to the hoops and/or channels and electronic identifiers could be coupled to the projectiles. The sensors could be configured to determine when a projectile has entered the corresponding hoop or channel by interrogating the electronic identifier of the projectile. In such examples, the placement of the projectiles and the resulting pattern could be displayed on an electronic display coupled to the device. Such examples may—but need not—obviate the use of channels, apertures in the channels for viewing the projectiles, the funnel, the releasable blocking mechanism, and the like.

Other features, elements, and embodiments are contemplated.

II. Example Device

Figure 1B:
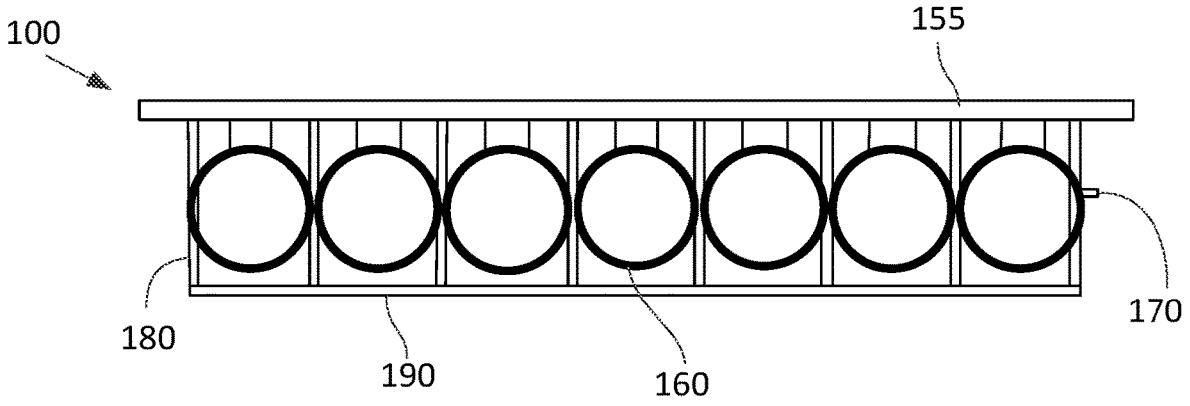
FIG. 1B illustrates a top view of the device of FIG. 1A.
Figure 1C:
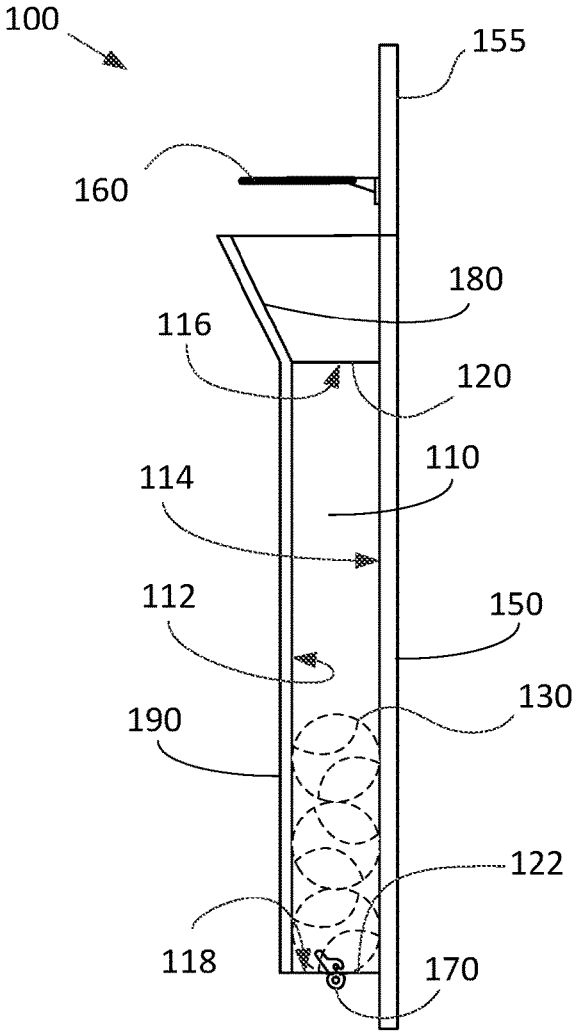
FIG. 1C illustrates a right side view of the device of FIGS. 1A and 1B.

FIGS. 1A-C illustrate an example device of the present disclosure. FIG. 1A shows a front (i.e., player-facing) side view of the example device, while FIG. 1B and FIG. 1C show a top view and a right side view of the example device, respectively.

As illustrated in FIG. 1A, the device 100 includes a plurality of substantially vertical longitudinal channels 110 arranged in parallel. The channels 110 have a front end 112 a back end 114 (see FIG. 1B), two side ends 111, 113 (see FIG. 1A), a top end 116, and a bottom end 118. Each of the plurality of channels has openings 120, 122 at the respective top (120) and bottom (122) ends. The channels 110 are configured to receive projectiles 130 through one or more of the openings 120, 122 and retain the projectiles 130 in positions along the channels 110. The channels 110 may be sized to loosely receive the projectiles 130, such that the projectiles 130 may freely move longitudinally through the channels 110 (e.g., from a top end 116 opening of the channel to the bottom end 118 of the channel) once they have been received into the channels 110. In one example, the projectiles 130 could be approximately basketball-sized and the channels 110 could include a diameter or width (i.e., a distance between a front end 112 and a back end 114 and/or a distance between two size ends 111, 113) of about 8 inches. However, a range of sizes are envisioned. For example, the channels 110 could comprise a diameter or width of approximately 9 inches, about 10 inches, or about 11 inches.

In some examples, the plurality of channels 110 includes a plurality of substantially vertical cylindrical channels arranged in parallel. However, in other examples the plurality of channels 110 could include a plurality of square-shaped or rectangular-shaped subdivisions of some larger game grid. In such an example, the plurality of channels 110 (i.e., the game grid) may include at least a back plate (e.g., the backing surface 150 or another back plate) defining the back ends of the channels, two side plates defining two side ends of the outermost channels, and a front plate (e.g., plate 190) defining the front ends of the channels 110. Each channel of the plurality of channels 110 may be defined by a partition extending from the front plate to the back plate, the partitions forming side ends of the interior channels.

The channels 110 may be defined by a rigid material, for instance, a plastic, a metal (e.g., an aluminum or aluminum composite), a rigid polymer, or some other material. However, in other examples it may be favorable to provide channels 110 that are flexible, foldable, collapsible, malleable, and/or adaptable. For instance, it may be desirable to transport, package, or sell the device in a smaller state in order to more easily sell to consumers and the general public, transport the device, or for some other reason. In such examples, the channels 110 may be defined by a flexible material, for instance, a flexible polymer, a textile, or some other flexible material.

In some examples, the plurality of channels 110 may be arranged in parallel in a fixed manner, such that the position of each channel is fixed relative to adjacent channels. In such a case, each of the plurality of channels 110 may be irreversibly attached to an adjacent channel and/or defined within a game grid, as described above. However, in other examples each of the plurality of channels 110 may be removably attached such that the channels may be moved and rearranged relative to each other. In various examples, adjacent channels could be coupled by way of an adhesive, a hook and loop connector (e.g., Velcro), a mechanical coupler (e.g., a latch, a snap) or some other coupling means.

Additionally or alternatively, the plurality of channels 110 could be configured to mount to a backing surface 150 that maintains the channels 110 in a substantially vertical position. The backing surface 150 could be, for example, a panel, a wall, a door, the side of a vehicle (e.g., a semi-truck), or some other surface. The back ends 114 of the channels 110 (e.g., a back panel forming the back ends of the channels) could be coupled to the backing surface 150 by way of an adhesive, hook, hanger, hook and loop connector, a mechanical coupler, or some other attachment mechanism. However, in other examples the backing surface 150 defines the back ends 114 of the channels 110. In some cases, the plurality of channels 110 could be rigid and freestanding, i.e., able to maintain themselves in a substantially vertical position without a stand or backing surface 150.

The channels 110 are configured to receive projectiles 130 into positions along the channels 110, such that patterns can be made with the projectiles retained in the channels 110. In some examples, a plurality of apertures is provided such that the projectiles 130 positioned within the channels 110 are visible through the apertures 140. The apertures 140 may form a two-dimensional grid over the channels 110, thereby allowing players to view the projectiles 130 within the channels 110 while defining positions for pattern building in the game grid.

In some cases, the apertures could be disposed in the channels (e.g., in a material forming the front ends 112, back ends 114, and/or side ends 111, 113 ends of the channels 110). Additionally or alternatively, one or more plates containing a series of apertures may be positioned over the front (i.e., player-facing) ends of the plurality of longitudinal channels. The one or more plates 190 could contain the plurality of apertures 140 located such that the apertures form a two-dimensional grid across the channels 110. Vertical columns of the grid may be defined by the plurality of channels 110, such that the apertures 140 of each column are arranged vertically across a channel. The number of vertical columns may correspond to the number of channels 110 of the device. Meanwhile, the horizontal rows of the grid are arranged across the plurality of columns, with each aperture of the row corresponding to a different one of the plurality of columns. In one embodiment, the one or more plates 190 include a single plate that extends across the front ends 112 of all of the plurality of channels 110. However, in some instances a plurality of plates 190 may be used with, e.g., one plate corresponding to each channel, one plate corresponding to each vertical column or horizontal row, one plate corresponding to each aperture, or some other number and configuration of plates.

The two-dimensional grid formed by the apertures 140 can include any desired number of vertical columns and horizontal rows. The number of vertical columns and/or horizontal rows may be based on, for example, a type of game or a desired difficulty of the game. In a particular example, the pattern-building game could include tic-tac-toe, and the grid could include 3 horizontal columns and 3 vertical rows. In another example, the pattern building game could include a game relating to forming a pattern of a number of adjacent projectiles (e.g., 4 projectiles in a row) within the channels 110. In such an example, the grid could include 6 horizontal rows and 7 vertical columns. In a further example, the grid includes 5 horizontal rows and 5 vertical columns. However, the two-dimensional grid could be of any desired size. For examples, the grid could include 2, 3, 4, 5, 6, 7, 8, 9, 10, or more vertical columns, where the number of vertical columns is defined by the number of channels 110 provided by the device 100. Similarly, the two-dimensional grid could include 2, 3, 4, 5, 6, 7, 8, 9, 10, or more horizontal rows. Additional and alternative pattern-building games and grid sizes are contemplated.

In some examples, the apertures 140 include cut-outs in the one or more plates 190 and/or one or more end(s) of the channels 110. However, in other examples, the apertures could include areas of transparent material (e.g., a polymer, glass, etc.) located within the channels 110 and/or plates 190 that allow a user of the device to view the projectiles within the channels 110. The apertures 140 may be sized according to the size of the channel 110, the size of the projectiles 130, or for some other purpose. In various examples, the apertures 140 could include apertures with a diameter between 4 inches and 6 inches, 5 inches and 7 inches, or some other desired size. Furthermore, the apertures 140 may take a variety of shapes, for instance, a circular shape, a square shape, an oblong shape, a shape that reflects the shape of a projectile 130, the shape of a design or logo, or some other configuration.

The apertures 140 may be located such that each aperture of the grid is approximately one projectile-sized length away from an adjacent aperture in the same vertical row and/or horizontal column. As used herein, the term "projectile-sized length" defines the distance between two projectiles 130 received into positions along a channel 110 and/or stacked vertically within the channel 110. In such a configuration, a first projectile positioned in a channel will be visible through a first aperture; a second projectile positioned in the same channel will be visible through a second aperture in the channel, and so on.

In various examples, the projectiles 130 could include basketballs, soccer balls, volleyballs, golf balls, dodgeballs, or some other sports balls. In some examples, the projectiles 130 include spherical or approximately spherical balls of any desired size. The projectiles 130 could include a circumference of about 29.5 inches (i.e., approximately regulation basketball-sized) and the channels 110 could be sized to loosely receive the projectiles 130. However, the projectiles 130 may include balls of any desired size—for instance, balls with a circumference of approximately 22 inches, approximately 25.5 inches, approximately 27.5 inches, approximately 28.5 inches, or some other size. Other projectiles and sizes are contemplated.

In some examples, the projectiles 130 may be divided into one or more subsets of projectiles representing a certain player, a team, a point value, or some other characteristic. A first subset of the projectiles could include a distinguishing feature that differentiates the first subset of projectiles from a second subset of the projectiles. In various embodiments, the distinguishing feature could include a color, a design, a pattern, a logo or insignia (e.g., for a sports team or advertiser), a marking or pattern, a shape, or some other feature of the projectiles 130.

In some examples, the device includes a releasable blocking mechanism 170 to selectively maintain one or more projectiles 130 within the channels, such that further projectiles 130 received into the same channel accumulate and form a vertical stack on top of the first projectile. The releasable blocking mechanism 170 could include a retaining mechanism disposed below the bottom end 118 of the plurality of channels 110 such that the bottom end openings 120 of the channels 110 are obstructed. As shown in FIG. 1A, the releasable blocking mechanism 170 may be coupled to or to the bottom ends 118 of the plurality of channels 110. However, in other examples the releasable blocking mechanism 170 could be coupled to a backing of the device 150, the one or more panels 190, or some other element of device 100.

Figure 2A:
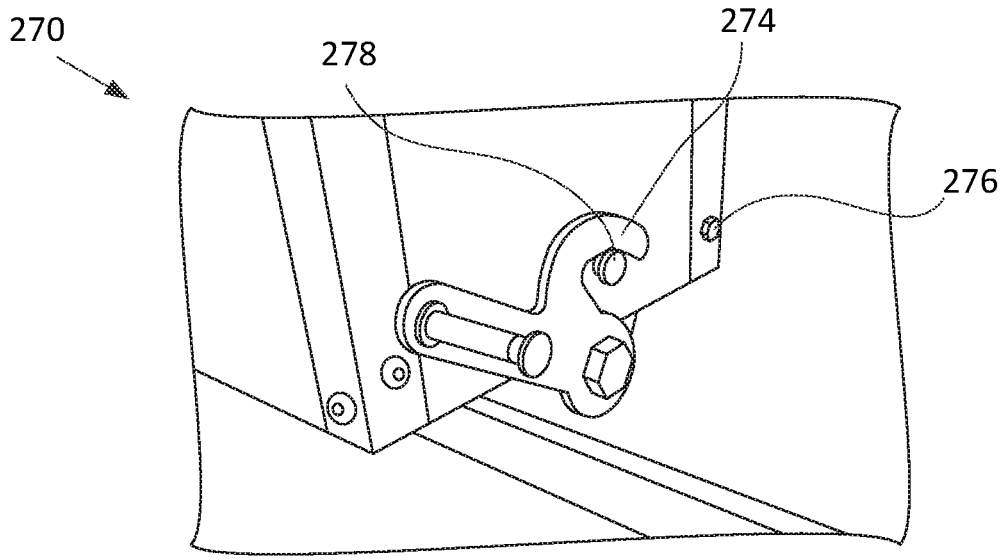
FIG. 2A illustrates a perspective view of a releasable blocking mechanism in a first position, according to an example embodiment.
Figure 2B:
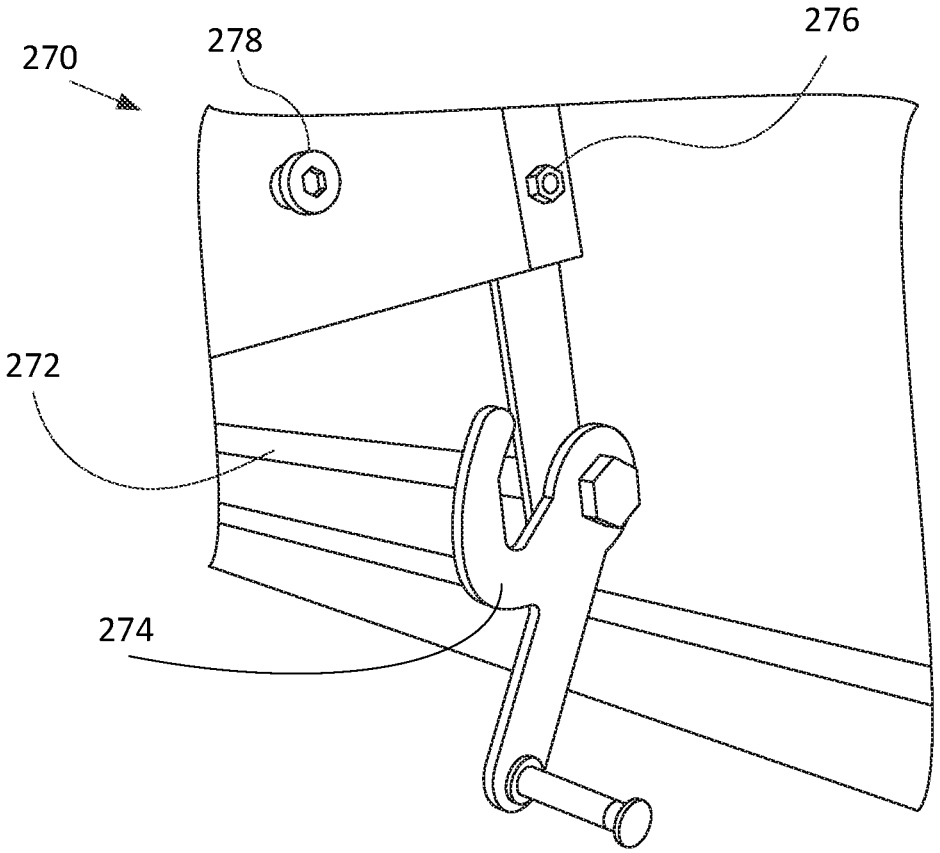
FIG. 2B illustrates a perspective view of the releasable blocking mechanism of FIG. 2A in a second position.

An example releasable blocking mechanism is illustrated in FIGS. 2A-B coupled to the bottom right side end of the plurality of channels. The releasable blocking mechanism includes a retaining mechanism 272 and a latching mechanism 274 configured to move the retaining mechanism between a first position and a second position. FIG. 2A shows the releasable blocking mechanism in the first position and FIG. 2B shows the releasable blocking mechanism in a second position.

The releasable blocking mechanism 270 could be configured to either prevent received projectiles from exiting the bottom end of the channels when disposed in a first position (i.e., a retaining position; FIG. 2A), or allow the received projectiles to exit the bottom end of the channels when disposed in a second position (i.e., a release position; FIG. 2B). When disposed in the first position, the releasable blocking mechanism 270 could prevent received projectiles from exiting the channels by impeding the opening of the channels with the retaining mechanism 272. In various examples, the retaining mechanism 272 could include a horizontal bar, a door, a panel, or some other physical barrier.

In order to selectively release the projectiles from the channels when desired by a player, a latching mechanism 274 may be provided, which is configured to move the retaining mechanism 272 between the first position and the second position. In some examples, the latching mechanism 274 is mechanically coupled to the retaining mechanism 274 (e.g., the horizontal bar, a panel, a door, or other barrier) such that moving the latching mechanism 272 positions the retaining mechanism 274 to obstruct the openings in the bottom ends of the channels. In some instances, a separate releasable blocking mechanism 270 is provided for each of the plurality of channels, such that projectiles may be controllably released from each channel independently. However, in other examples, the releasable blocking mechanism 270 may be configured to retain and/or release projectiles from all of the plurality of channels simultaneously.

In some examples, the retaining mechanism 272 is pivotable between the first (i.e., retaining) position and the second (i.e., release) position by way of a hinge 276, such that the retaining mechanism 272 can be readily pivoted to either retain or release the projectiles from the channel, as needed. The hinge 276 may be disposed on one or more of the channels, one or more of the plates, or on backing surface of the device. In order to prevent the projectiles from being released backward (i.e., away from a player and/or toward a backing surface of the device) the hinge 276 could be configured to pivot the retaining mechanism 272 backward when it is disposed in a release position. Such a configuration is illustrated in FIG. 2B, wherein the retaining mechanism 272 is substantially aligned with the back end of the plurality of channels proximate to the backing surface in the second position (i.e., release position).

In order to maintain the releasable blocking mechanism 270 in the retaining position while the game is in play (i.e., when projectiles are received in the channels), the latching mechanism 274 may be configured to reversibly couple to a pin 278 (e.g., a bolt). As illustrated in FIG. 2A, the pin 278 could be disposed on one or more of the channels and configured to maintain the retaining mechanism 272 in the first position (i.e., retaining position). However, in other examples the pin 278 could be disposed on a backing surface, on one or more of the panels, or on another element of the device.

Additional or alternative releasable blocking mechanisms are envisioned. For instance, in some cases the retaining mechanism 272 includes a panel disposed proximate to the bottom end of the plurality of channels. The panel could be arranged to obstructs the bottom end openings of the channels when disposed in a first (i.e., retaining) position. The panel could be configured to be slid into the retaining position underneath the channels, and could be maintained in the retaining position by grooves or other mechanical features disposed on the channels and/or backing surface. In order to release the projectiles from the channels, the panel could be slid out from under the plurality of channels.

Additionally or alternatively, a hook and loop connector (e.g., Velcro) or an adhesive may be disposed on one or more surfaces of the channels and/or releasable blocking mechanism 270 and configured to maintain the retaining mechanism 272 in a retaining position. In a particular example, the retaining mechanism 272 includes one or more panels, flaps, doors, or other mechanisms and is reversibly attached to the bottom ends of the channels by way of a hook and loop connector. Moving the retaining mechanism 272 into the release position could include removing the retaining mechanism 272, i.e., by detaching the retaining mechanism from the bottom ends of the channels by detaching a hook and loop connector. Other releasable blocking mechanisms and means are also contemplated.

Returning to FIGS. 1A-C, in some examples the device 100 includes a plurality of hoops 160. The hoops 160 could include rims that define an opening through which a projectile can pass. In some examples, the hoops 160 further include nets coupled to the rims and configured to gently guide the projectiles through the hoops 160. In some examples, the hoops 160 could include regulation basketball rims (i.e., basketball hoops with a diameter of about 18 inches). However, the hoops 160 could be sized for any number of different projectiles 130, channels 110, and games. For example, the size of one of the hoops 160 could be approximately equal to the cross-sectional area of one channel 110, approximately equal to or greater than the cross-sectional area of a projectile 130, approximately double the cross-sectional area of a projectiles 130, or some other desired size.

The plurality of hoops 160 could be disposed vertically above the top ends 116 of the channels 110, such that a projectile 130 received by one of the hoops 160 is directed into a corresponding channel 110. The hoops 160 may be coupled to the top ends 116 of the plurality of channels 110 and/or configured to be attached to a backing surface 150 of the device 100 vertically above the plurality of channels 110. In some cases, the plurality of hoops 160 is provided in a 1:1 ratio with the plurality of channels 110, and each hoop 160 may corresponds to a different one of the channels 110. However, in other situations there may be a greater or lesser number of hoops 160 compared to the number of channels 110. For instance, two, three, or more of the plurality of hoops 160 may correspond to a single one of the plurality of channels 110, with different hoops corresponding to differing probabilities of entering a given channel, different point values, different difficulties, or some other difference.

In some examples, the hoops 160 are disposed vertically above and aligned with the top end openings 120 of the channels 110 such that a projectile 130 received by one of the hoops 160 falls downward into the opening 120 of the channel below. However, alternative embodiments are contemplated. For instance, the hoops 160 may be disposed vertically above and angled at approximately 90 degrees in relation to the channels 110 (i.e., such that a path extending through the center of one of the hoops 160 intersects at approximately 90 degrees with a path extending longitudinally through one of the channels 110), such that a projectile 30 that advances through a hoop horizontally then falls downward into an opening 120 in a channel 110 below.

In some implementations, a backboard 155 or a plurality of backboards 155 may be provided proximate to the plurality of hoops. The backboard 155 may be configured to prevent projectiles 130 from advancing behind the plurality of hoops 160. The backboard(s) 155 may be disposed behind the plurality of hoops 160 and act as a barrier, such that a projectile thrown past the hoops collides with the backboard and is prevented from landing behind the device 100. In some cases, a plurality of backboards 155 could be provided, with each one of the plurality of backboards 155 corresponding to and disposed proximate to one of the plurality of hoops 160. However, in other examples a single backboard 155 could be disposed proximate to all of the plurality of hoops and be configured to prevent projectiles from advancing behind any of the plurality of hoops 160. In some cases, the backboard 155 may include a portion of the backing surface 150. However, in other examples, the backboard 155 and backing surface 150 are spatially separate and distinct. In various examples, the backboard(s) could include a regulation backboard (i.e., a regulation backboard of a basketball rim), a vertical or angled wall, a net, or some other barrier.

Additionally or alternatively, the device could include a funnel 180 positioned between the plurality of hoops 160 and the plurality of channels 110. The funnel 180 includes a top end configured to receive the projectiles and a bottom end coupled to the plurality of channels 110. The funnel 180 may be arranged to guide any projectiles 130 passing through any one of the hoops 160 directly into the corresponding channel 110. In this context, the term "directly" is used to indicate that the projectiles 130 may immediately enter the channels 110 upon exiting the funnel 180, i.e., without traversing an intermediate pathway, ramp, chute, slide, etc. The funnel 180 may be coupled to the top edge 112 of the channels and/or the backing surface 150. The width of a bottom end of the funnel 180 could be sized approximately to a width of the plurality of channels 110. Likewise, a width of the top end of the funnel 180 may be sized approximately to the width of the plurality of hoops 160, i.e., so as to only capture projectiles 130 that have passed through the plurality of hoops 160.

The funnel 180 may be composed of the same material as the channels 110, e.g., a polymer or a metal (e.g., aluminum or an aluminum composite). However, in other examples, the funnel 180 could include a netting and/or textile. In some examples, the funnel 180 may also include a plurality of partitions that define a plurality of specified pathways through the funnel. In such an example, the partitions could be arranged such that each pathway corresponds to one of the hoops 160 and is configured to receive a projectile from the hoop 160 and vertically guide the projectile 130 into a corresponding channel (i.e., such that the projectile is prevented from passing into a non-corresponding channel).

Additional features and elements are also anticipated. For example, to facilitate removal of the projectiles 130 from the channels 330, the device 100 could include a gathering mechanism configured to receive projectiles 130 from the bottom end openings 122 of the channels 110 when the releasable blocking mechanism 170 is in the second position. The gathering mechanism could be coupled to the bottom ends 118 of the channels 110, and could include, e.g., a net, bag, or another container. In other examples, the gathering mechanism could include a ramp, a slide, or some other incline disposed beneath the bottom ends 118 of the channels 110. Such an incline could be configured to divert or control the path of the projectiles 130 when the projectiles 130 are released from the channels 110, i.e., such that the projectiles 130 roll toward a player of the pattern-building game when released from the channels 310.

Figure 3:
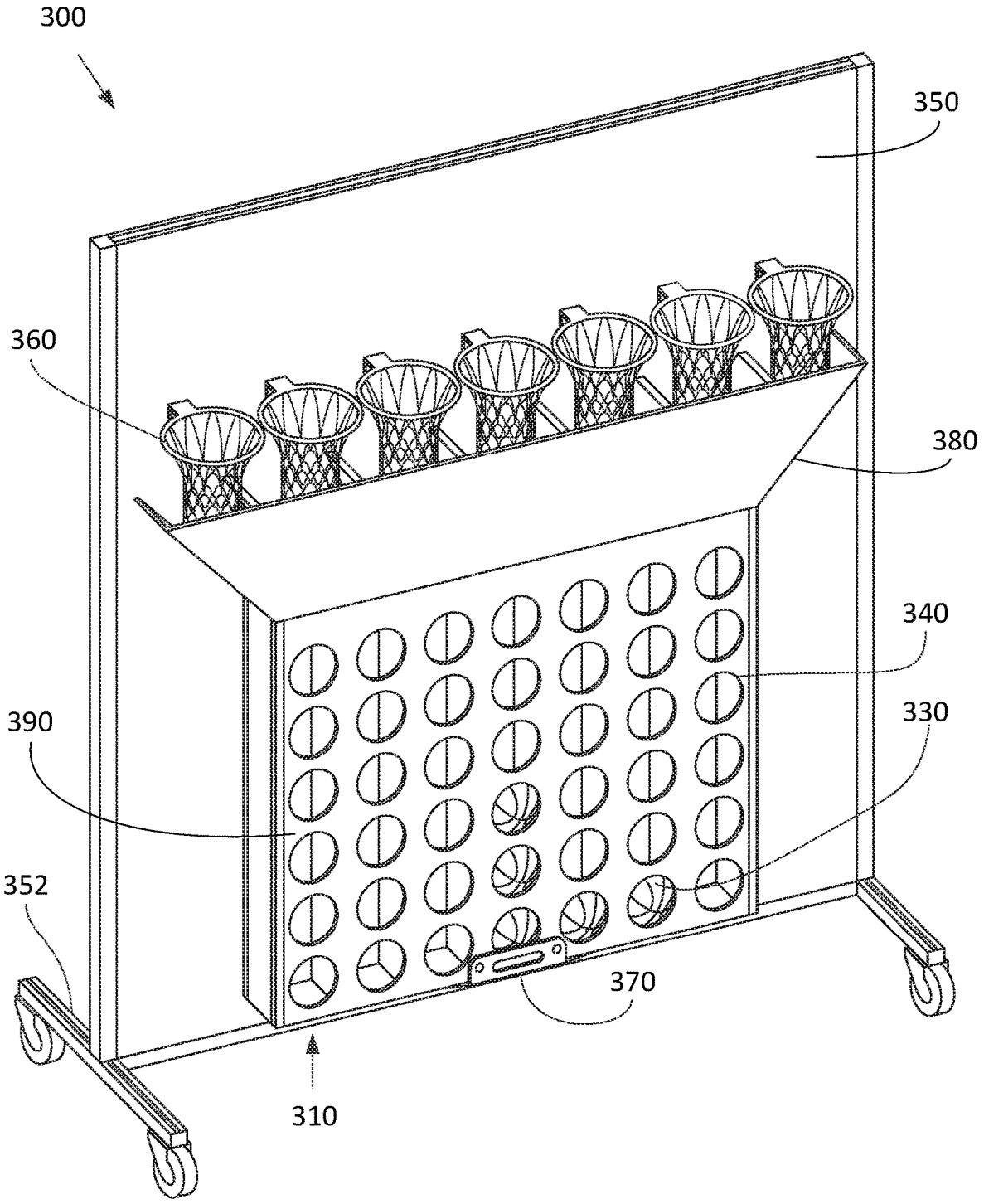
FIG. 3 illustrates a perspective view of a device, according to another example embodiment.

FIG. 3 illustrates a perspective view of a device 300, according to another example embodiment. Such a device includes a plurality of substantially vertical longitudinal channels 310, the channels configured to receive projectiles 330. In this example, one continuous plate 390 is positioned over the front ends of the channels 310, the plate 390 defining a two-dimensional grid of apertures 340 that allow a player to view the projectiles 330 within the channels 310. The device further includes a plurality of hoops 360 disposed vertically above the channels 310, with each hoop corresponding to a different channel. A funnel 380 is positioned between the plurality of hoops 330 and the plurality of channels 310 and is arranged to guide projectiles 330 passing through any one hoop into the corresponding channel. A releasable blocking mechanism 370 is positioned at the bottom ends of the longitudinal channels 310 and selectively retains the projectiles 330 within the channels 310.

The releasable blocking mechanism 370 of the device 300 could function similarly as the releasable blocking mechanisms described in relation to FIGS. 1A-C and 2A-B. However, alternative examples are also anticipated. For instance, as illustrated in FIG. 3, the releasable blocking mechanism 370 could include a retaining mechanism (e.g., a panel or door) and a handle. In a first position (i.e., a retaining position, see FIG. 3), the retaining mechanism could be disposed beneath the plurality of channels 310 and arranged to obstruct the openings in the bottom ends of the channels 310. In a second position (i.e., a release position) the retaining mechanism could be aligned with the backing surface 350 of the device 300 such that the received projectiles 330 may exit the bottom end openings of the channels 310. The releasable blocking mechanism 370 could include a handle configured to move the retaining mechanism between the first position and the second position, such that a user of the device 300 can selectively release the projectiles 330 from the channels 310 by way of the handle. The handle could be configured to maintain the retaining mechanism beneath the channels (i.e., in the first position) by way of a snap fit against the one or more panels 390 or some other element of device 300.

As shown in FIG. 3, one or more of the elements of device 300 could be attached to a backing surface 350. The backing surface 350 could facilitate transport, storage, and/or setup of the device. For example, the backing surface could include a stand 352 configured to maintain the channels 310 in a substantially vertical position. In some scenarios, the backing surface 350 could include wheels, e.g., a wheeled stand or a motor vehicle, such that the device 300 may be readily transported from one location or event to another. Such a backing surface 350 may also affect elements of the pattern-building gameplay, for instance, by acting as a backboard (i.e., acting similarly to backboard 155 of FIGS. 1A-C) to deflect projectiles 330. In some examples, the channels 310, the hoops 360, the releasable blocking mechanism 370, and/or the funnel 380 are configured to reversibly couple to the backing surface 350 and include respective attachment means (e.g., hooks, brackets, adhesives, hook and loop connectors, mounts, etc.). However, in other examples certain elements may be fixed with respect to the backing surface 350. In a particular example, the back ends of the plurality of channels 310 are coupled to the backing surface 350, and the plurality of hoops 360 is coupled to the backing surface 250 vertically above the plurality of channels 310. In some cases, the position of the channels 310 may be fixed, while the location of the hoops 360 is variable, so as to allow a player to increase or decrease the height of the hoops 360 in order to, e.g., adjust the difficulty of the pattern-building game.

The backing surface 350 could include, for example, a wall, a door, a panel, a vehicle (e.g., the back of a semi-truck, or some other vehicle), or some other surface. In some examples, the backing surface 350 could include a manual or electronic scoreboard and/or a display. The backing surface 350 or a display of the backing surface 350, the one or more panels 390, and/or other elements of the device 300 may further provide space for logos, advertisements, sponsor information, and the like.

While FIG. 3 illustrates a device 300 including a backing surface 350, in other examples elements of the device 300 could be configured to be freestanding. For example, the channels 310 could include a rigid material configured to maintain the channels in a substantially vertical position without a backing surface. Additional elements (e.g., the one or more plates 390, the funnel 380, the plurality of hoops 360, and the like) could be configured to mount or attach to the rigid channels 310. In another embodiment, elements of the device 300 could be foldable, collapsible, or otherwise dis-assemblable. For example, the channels 310, the funnel 380, and/or the plate 390 could be configured to be folded or disassembled into a smaller state. Such a configuration may facilitate transport and storage by allowing the device to collapse, deflate, and shrink during storage and transportation. Other materials and setups are contemplated.

Such a device 300 may be provided in a variety of form factors and configurations. For example, it may be beneficial to provide a larger scale device 300 configured to be attached to a semi-truck, which can be leased and driven to, e.g., an outdoor concert or sporting event. In other scenarios, (e.g., for consumer or at-home play), a smaller device 300 may be provided that can be folded, disassembled, deflated, or otherwise shrunk for packaging, transit, and storage. Similarly, a model could be provided that attaches to a wall, the back of a door, or some other surface so that it can be played at home or in smaller areas. In such examples, a slim form factor may be desired, with a depth (i.e., a distance between a backing surface 350 of the device 300 and the one or more plates 390) being in the range of about 6 inches to about 18 inches.

Figure 4:
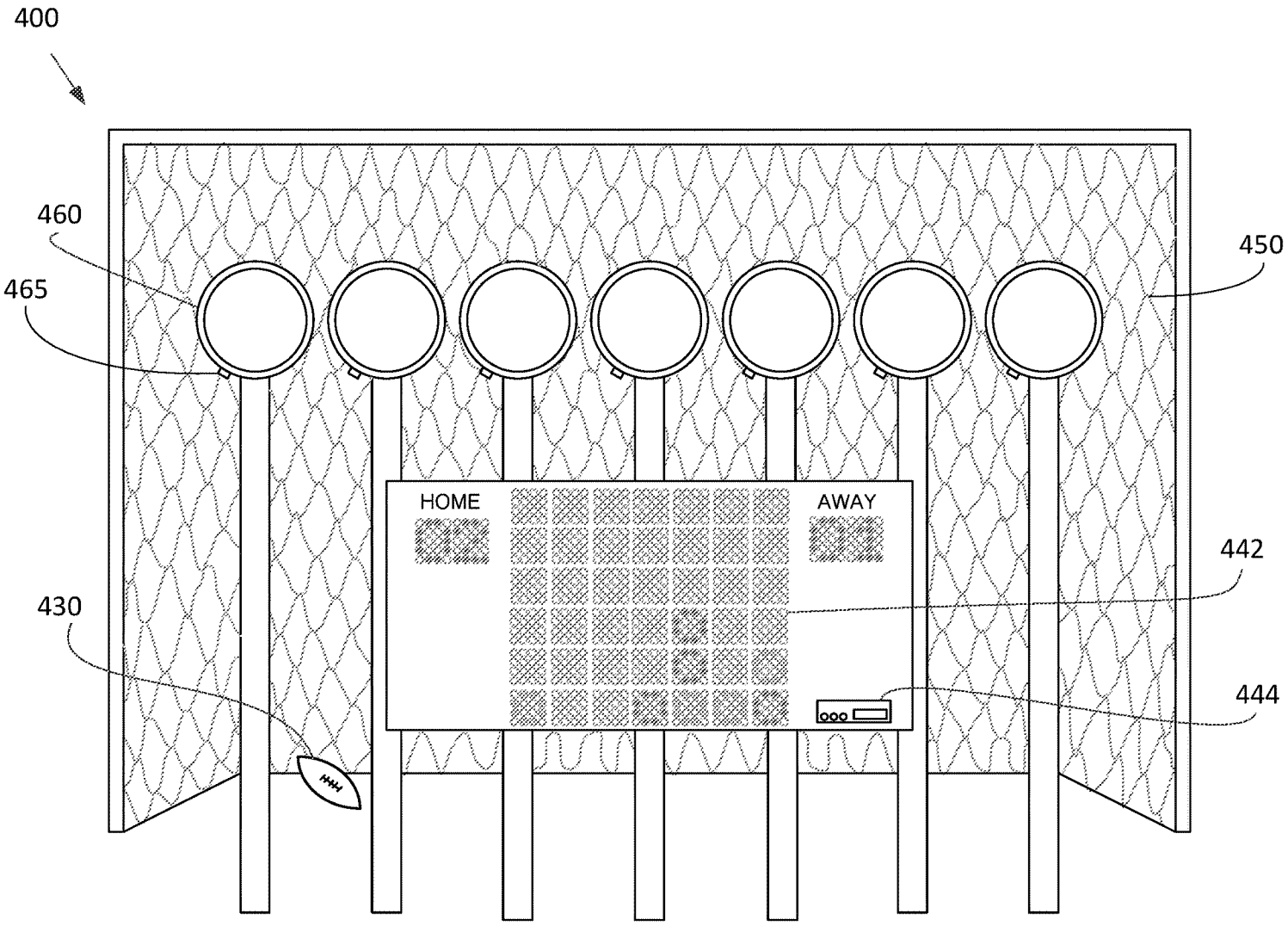
FIG. 4 illustrates a front side view of a device according to another example embodiment.

Alternative configurations of the device 300 may be used to accommodate for differently shaped projectiles and/or different gameplay mechanics. For instance, in some examples the projectiles 330 are non-spherical and therefore may not stack in predefined orientations within the channels 310. Additionally or alternatively, it could be desirable to facilitate scorekeeping or gameplay through the use of electronic components, displays, user interface(s), and the like. FIG. 4 illustrates one such embodiment of a device 400, featuring projectile(s) 430, a plurality of hoops 460, a plurality of sensors 465, a collection mechanism 450, a display 442, and a user interface 444. Such examples may—but need not—obviate the use of channels, apertures in the channels for viewing the projectiles, a funnel, a releasable blocking mechanism, and the like.

In such an implementation, the device 400 may include a plurality of hoops 460 arranged in parallel and configured to receive projectiles 430. In various examples, the projectiles 430 could include spheroids or oblong projectiles (e.g., American footballs), cylindrical or flattened projectiles (e.g., Frisbees™), spherical projectiles (e.g., sports balls or, more specifically, basketballs) or some other shape. The plurality of hoops 460 could be arranged to face a player of the game, i.e., such that the openings of the hoops 460 are at approximately a 90 degree angle from the ground. The openings of the hoops 460 could include any desired shape, for instance, a circular shape or a rectangular shape. Additionally, the hoops 460 could be located at any desired height from the ground, for instance, approximately 4', approximately 6', approximately 8', approximately 10', approximately 12', or some other height. In some examples, each of the plurality of hoops 460 is disposed at the same height. However, in other examples different ones of the plurality of hoops 460 may be placed at variable heights depending on, e.g., point values, a desired difficulty, a player age or skill level, or some other variable.

In such an example, a collecting mechanism 450 may be provided to receive any projectiles 430 that pass through the hoops 460. Such a collecting mechanism 450 may be positioned behind the plurality of hoops 460 and arranged to collect any projectiles 430 passing through any one of the hoops 460. In some examples, the collecting mechanism could extend beyond the openings of the plurality of hoops 460 and be arranged to collect any projectiles 430 thrown in the direction of the hoops 460 (i.e., such that the collecting mechanism 450 collects the projectiles 430 whether or not the projectiles 430 are received by the plurality of hoops 460). As illustrated in FIG. 4, the collecting mechanism 450 could include a net with a height and/or width greater than the height and/or width of the plurality of hoops 460. In other examples, the collecting mechanism 450 may be coupled to a rim of at least one of the plurality of hoops 460 (i.e., attached around the circumference of the hoop), such that only projectiles 430 that advance through a hoop enter the collecting mechanism 450. Each of the plurality of hoops 460 may be connected to a separate collecting mechanism 450, such that the projectiles 430 received by different hoops are collected by separate collecting mechanisms. However, in other examples a single collecting mechanism 450 is coupled to the rim of all of the plurality of hoops 460 and is arranged to collect any projectiles 430 passing through any of the plurality of hoops 460.

While insofar the device 300 has largely been described without including electronic elements, sensors, and the like, electronic implementations are also considered. Such implementations may streamline aspects of the gameplay by allowing for electronic scoring, displaying of points and/or projectile locations on a display, providing a user interface, notifying players when a winning pattern has been made, or by providing some other advantage.

In a particular example, the device includes a plurality of sensors 465. Each sensor 465 could be disposed on a corresponding one of the plurality of hoops 460 and configured to detect a projectile 430 received by the corresponding hoop. Similarly, the projectiles 430 could include tags configured to transmit information relating to the projectiles 430 to the sensors 465. A first subset of the projectiles 430 may include a first subset of tags, while a second subset of the projectiles 430 includes a second subset of tags, such that the first subset of projectiles can be distinguished from the second subset of projectiles.

In some scenarios, the sensors 465 could include RFID readers, the tags could include RFID tags, and detecting a projectile received by the hoops 460 could include interrogating the RFID tags with the RFID reader. Such RFID readers could be configured to emit radiofrequency waves. Similarly, the RFID tags could include integrated circuits and antennas configured to receive the radiofrequency waves and transmit information to the RFID readers. In this context, interrogating the RFID tag could include transmitting radiofrequency waves to the tag and receiving information transmitted from the tag. Such information could include information relating to a subset of the projectile 430 (e.g., a first subset of projectiles relating to a first team of players, a second subset of the projectiles relating to a second team of players, etc.), a point value of the projectile 430, or some other information.

In one embodiment, each of the plurality of hoops 460 includes a sensor 465 (e.g., a RFID reader) configured to interrogate an RFID tag of a projectile 430 when the projectile passes through any one of the plurality of hoops 460. The plurality of sensors 465 could be configured to receive information from the tags on the projectiles 430 and determine, based on at least the received information, which hoop 460 of the plurality that the projectile 430 entered, and/or the subset of projectile 430 that entered the specified hoop 460. The information may then be used to determine a pattern or score of the game, a winner of the game, or make some other determination.

In some examples, the device 400 includes a display 442, for instance, an LED, LCD, or OLED display, a series of light bulbs arranged in a grid and configured as a display, or some other visual display. The display 442 could located on, e.g., a backing surface of the device 400, one or more of the hoops 460 of the device 400, on a stand or support, on a smartphone, tablet, or mobile computing device, or some other location. Such a display 442 could be configured to provide a text or image output, for instance, a number of received projectiles 430 by one or more of the hoops 460, a pattern of the projectiles 430, a location of the received projectile(s) 430, a point value corresponding to the projectile(s) 430 and/or player(s), a number of games won, a turn or turn order of the game, or some other information.

In some examples, the display 442 includes a two-dimensional grid including a number of horizontal rows and vertical columns. In some examples, the number of vertical columns may be equal to the number of hoops 460 of the device 400. In such an example, each vertical column of the two-dimensional grid may correspond to one of the plurality of hoops 460. In various embodiments, the grid could include 3 horizontal rows and 3 vertical columns, 5 horizontal rows and 5 vertical columns, 6 horizontal rows and 7 vertical columns, or any other dimensions.

The display 442 could be communicatively coupled (i.e., coupled via a wired or wireless connection) to the plurality of sensors 465 disposed on the plurality of hoops 460. Responsive to a determination by the sensors 465 that a projectiles has been received by one of the plurality of hoops, the display 442 could be configured to display an indicator. In order to allow a player to build a pattern using the projectiles 430, the display 442 could be configured to indicate when a projectile 430 passes through one of the plurality of hoops 460 by displaying an indicator in the corresponding vertical column of the two-dimensional grid. In some examples, the indicator is displayed in a first position in the vertical column corresponding to a first horizontal row of the grid. When the sensors 465 determines that a subsequent projectile 330 has entered the same hoop 460, a subsequent indicator may be displayed in an adjacent second position in the same vertical column corresponding to a second horizontal row of the grid. Further indicators may be displayed in the third, fourth, and further positions in the vertical column(s) when further projectiles 430 are received by the hoops 460 until the game is completed, i.e., when a player creates a desired pattern on the display 442.

In some examples, the device 400 also include a user interface 444, for instance, further displays, inputs, touchscreens, buttons, and other elements to facilitate receiving information and user inputs. In some examples, the user interface 444 could be operable to reset the score and/or indicators on the display responsive to a user input. Additionally or alternatively, the user interface 444 could be operable to start the game (i.e., initiate the display 442, sensors 465, and/or other electronic components); change a turn or turn order; select a desired game or difficulty level; receive information about desired rules, winning conditions, or game mechanics; receive information relating to the players; or receive some other user input.

In some cases, the device 400 could be configured to output a notification (e.g., on the display 442 or user interface 444) when a desired "winning" pattern is created by one or more of the players (i.e., by throwing projectiles 430 into the plurality of hoops 460), or when the sensors 465 determine that indicators on the display 442 have created a winning pattern. Such a winning pattern could include any desired pattern, for example, a number of adjacent projectiles 430 or indicators (e.g., three in a row or four in a row), a predefined shape, or some other pattern.

While various examples and implementations have been disclosed, other examples and implementations will be apparent to those skilled in the art. The various disclosed examples and implementations are for purposes of illustration and are not intended to be limiting, with the true scope being indicated by the following claims.

What is claimed is:

1. A device comprising:

a plurality of substantially vertical longitudinal channels arranged in parallel and configured to receive projectiles, each of the plurality of channels respectively having a front end, a back end, two side ends, a top end and a bottom end, and wherein each of the plurality of channels have openings at their respective top and bottom ends one or more plates positioned over the front ends of the plurality of longitudinal channels, the one or more plates containing a plurality of apertures located such that the apertures form a two-dimensional grid across the channels;

a plurality of hoops disposed vertically above each of the top ends of the channels, each hoop corresponding to a different channel;

a funnel vertically positioned between the plurality of hoops and the plurality of channels, and arranged to guide any projectiles passing through any one of the hoops directly into the corresponding channel, wherein a front end of the funnel is vertically aligned with the front ends of the plurality of channels, and wherein a back end of the funnel is vertically aligned with the back ends of the plurality of channels;

a releasable blocking mechanism coupled to the bottom ends of the channels, the releasable blocking mechanism including a retaining mechanism and a latching mechanism configured to move the retaining mechanism between a first position and a second position, wherein the releasable blocking mechanism is configured to prevent received projectiles from exiting the channels in the first position and to allow the received projectiles to exit the channels in the second position; and a backing surface, wherein the back ends of the plurality of channels are coupled to the backing surface, and wherein the plurality of hoops is coupled to the backing surface vertically above the plurality of channels, and wherein a distance between the backing surface and the one or more plates is less than about 18 inches.

2. The device of claim 1, wherein the projectiles comprise a circumference of about 27.5 inches, about 28.5 inches, or about 29.5 inches, and wherein the channels are sized to loosely receive the projectiles.

3. The device of claim 1, wherein the latching mechanism comprises a pin configured to maintain the retaining mechanism in the first position.

4. The device of claim 1, wherein the retaining mechanism is substantially aligned with the back ends of the plurality of channels in the second position.

5. The device of claim 1, further comprising:

a gathering mechanism coupled to the bottom ends of the channels, wherein the gathering mechanism is configured to receive projectiles that exit the channels.

6. The device of claim 1, wherein a first subset of the projectiles comprises a distinguishing feature that differentiates the first subset of the projectiles from a second subset of the projectiles.

7. The device of claim 6, wherein the distinguishing feature comprises at least one of a color, a design, a pattern, or a logo.

8. The device of claim 1, wherein the two-dimensional grid comprises 6 horizontal rows and 7 vertical columns.

9. The device of claim 1, wherein the two-dimensional grid comprises 5 horizontal rows and 5 vertical columns.

10. The device of claim 1, further comprising:

an attachment feature configured to secure one or more of the channels onto the backing surface.

11. The device of claim 1, wherein a distance between the backing surface and the one or more plates is in a range of about 6 inches to about 18 inches.

12. The device of claim 1, further comprising:

a stand that is configured to maintain the plurality of channels in a substantially vertical position.

13. The device of claim 1, wherein the funnel comprises a top end configured to receive the projectiles and a bottom end coupled to the plurality of channels, wherein a width of the top end of the funnel is sized approximately to the width of the plurality of hoops, and wherein a width of the bottom end of the funnel is sized approximately to a width of the plurality of channels.

14. The device of claim 1, wherein the funnel comprises a plurality of partitions, the partitions defining a plurality of chutes, wherein each chute corresponds to one of the hoops and is configured to receive one of the projectiles from the hoops and vertically guide the respective projectile into the corresponding channel.

15. The device of claim 5, wherein the gathering mechanism comprises a net.

16. The device of claim 1, wherein the plurality of hoops comprises a plurality of regulation basketball rims.

17. The device of claim 1, wherein the retaining mechanism is pivotable between the first position and the second position by way of a hinge.

18. The device of claim 1, wherein the releasable blocking mechanism comprises a handle configured to move the retaining mechanism between the first position and the second position.

19. The device of claim 1, wherein the retaining mechanism comprises a panel.

* * * * *